United States Patent [19]

Cobbs, Jr. et al.

[11] Patent Number: 4,780,331

[45] Date of Patent: Oct. 25, 1988

[54] METHOD AND APPARATUS FOR INDUCTION CHARGING OF POWDER BY CONTACT ELECTRIFICATION

[75] Inventors: Walter H. Cobbs, Jr., Amherst; Harry J. Lader, Lakewood, both of Ohio; Merle N. Hirsh, Rochester, N.Y.; David H. Chow, Bridgewater, N.J.

[73] Assignee: Nordson Corporation, Amherst, Ohio

[21] Appl. No.: 136,510

[22] Filed: Dec. 28, 1987

Related U.S. Application Data

[63] Continuation of Ser. No. 615,935, May 31, 1984, abandoned.

[51] Int. Cl.[4] ..... B05D 1/04

[52] U.S. Cl. ..... 427/25; 427/31; 427/30; 427/57; 118/621; 118/626; 118/629

[58] Field of Search ..... 427/25, 31, 30, 57; 118/621, 626, 629; 239/3, 699; 361/226, 227, 233

[56] References Cited

U.S. PATENT DOCUMENTS

| | | | |
|---|---|---|---|
| 2,396,533 | 3/1946 | Root | 43/148 |
| 2,686,733 | 8/1954 | Burridge et al. | 427/25 |
| 2,748,018 | 5/1956 | Miller | 427/25 |
| 3,239,717 | 3/1966 | Peterson | 317/3 |
| 3,418,930 | 12/1968 | Rarey et al. | 118/621 |
| 3,653,758 | 4/1972 | Trimmer et al. | 118/621 |
| 3,672,927 | 6/1972 | Spiller et al. | 117/17 |
| 3,795,443 | 3/1974 | Heine-Geldern et al. | 427/57 |
| 3,888,207 | 6/1975 | Stutz et al. | 427/25 |
| 3,973,517 | 8/1976 | Hudson | 118/312 |

OTHER PUBLICATIONS

Hughes, Electrostatic Powder Coating, John Wiley and Sons, N.Y., ©1984 pp. 8–11.

*Primary Examiner*—Richard Bueker
*Attorney, Agent, or Firm*—Wood, Herron & Evans

[57] ABSTRACT

Method and apparatus for charging powdered particles and delivering only these charged particles to a workpiece. A high voltage electric field is created between upper and lower surfaces. Powder is continuously delivered to the lower surface. The lower surface is vibrated to bounce the particles so that each repeatedly contacts the lower surface and picks up an electrostatic charge with each contact. When the charge from the particle is great enough to overcome gravity, the particle levitates and is thereafter transported to a workpiece, where it adheres by electrostatic attraction. Three important features of this method are: (1) No uncharged particles are levitated to the workpiece, thereby eliminating the need for recirculating uncharged powder. (2) The method is capable of producing high throughput of charged particles. (3) The method is capable of producing powder with a controlled charge level.

17 Claims, 2 Drawing Sheets

METHOD AND APPARATUS FOR INDUCTION CHARGING OF POWDER BY CONTACT ELECTRIFICATION

This application is a continuation, of application Ser. No. 615,935, filed May 31, 1984, now abandoned.

BACKGROUND OF THE INVENTION

This invention relates to the method and apparatus for charging non-conductive powder particles. More particularly, the invention is directed to a method and apparatus for electrostatic spray coating wherein a charge is imparted to particles and thereafter the particles are transported to the surfaces of a workpiece which is to be coated with the particles. The charge on the particles holds them to the workpiece by electrostatic attraction.

In a powder coating system, articles to be coated are normally conveyed through a powder booth. There an electrostatic charge is imparted to the powder particles and the charged particles are delivered to the object to be coated. The object is maintained at ground potential so that the charged particles adhere to the object because of the force induced between the charged particles and the grounded object. A significant percentage of the particles delivered toward the workpiece do not adhere to it and drop to the bottom of the powder booth. Those particles are recirculated through the powder transport system for reuse.

The charging and delivery system for the powder has primarily been by the use of electrostatic guns. Each gun usually has a passageway of circular cross section through which powder, entrained in a stream of air, passes. Electrodes within the passageway create a corona discharge which ionizes the air surrounding the electrodes. The particles, entrained in the air, collide with the ions in the air and acquire these ionic charges.

The gun electrode is maintained at 30 kV to 100 kV DC with respect to the workpiece, which is normally maintained at ground potential. The high voltage between the gun electrode and the workpiece creates an electric field. The charged particles tend to follow the electric lines of force created by the electric field between the gun and the workpiece.

The foregoing system which has been generally described and which is in widespread use has several disadvantages.

One of the disadvantages is referred to as Faraday caging. The electric force lines between the gun and the workpiece do not penetrate well into recesses in the workpiece. As a consequence, the powder which tends to follow the electrical force lines does not penetrate well into the recesses resulting in uneven coating thickness throughout the workpiece.

Further, of the original ions created by the corona discharge, only about 0.1–0.5% of them are involved in collisions with the particles which cause the ions to give up their charge to the particles. The rest of the ions follow the force lines and travel to the workpiece. As the ions build up on the surface of the workpiece, they create a surface charge of the same polarity as the charged particles and thus tend to repel the oncoming particles.

SUMMARY OF THE INVENTION

An objective of the present invention has been to provide an improved method and apparatus for imparting a charge to powder particles.

Another objective of the present invention has been to provide a method and apparatus for charging powder particles which produces no free ions and hence produces no build-up of a repelling ion layer on the surface of the workpiece.

Another objective of the invention has been to provide a method and apparatus which produces no uncharged particles at the workpiece.

Another objective of this invention has been to provide a method and apparatus which is capable of being increased in size as necessary to provide greater throughputs of powder.

Another objective of the invention has been to provide a method and apparatus for delivering charged particles to an object to be coated in such a manner as to eliminate the effects of Faraday caging.

These objectives of the invention are attained by applying a high direct-current voltage between upper and lower surfaces. The lower surface is capable of being vibrated at some selected frequency, preferably within the acoustical range. The uncharged powder particles are delivered to the lower surface, where particles are charged by electrostatic induction at each contact. The vibrations of the lower surface bounce the particles repeatedly on the lower surface, thereby charging the particles by induction. More particularly, a particle engaging the surface will pick up charge and will be bounced upwardly by the vibration of the surface. The particle will fall back to the vibrating surface and pick up additional charge at another location on the particle surface. This bouncing and inducing of charge will be repeated until the total charge on the particle is great enough to cause an upwardly-directed electrostatic force great enough to overcome the force of gravity, thereby causing the particle to levitate, that is, to have an upward velocity in the air. If the objective is to coat a workpiece, the levitated particles may impinge on a workpiece forming the upper surface or may be carried off by a flow of air or another electrostatic field which directs the particles to the workpiece.

The structure by which the method of the invention is given effect may take any one of a number of forms, some of which will be described in greater detail below. One form of structure may consist of a horizontal conductive plate surrounded by upwardly inclined insulating surfaces. A powder is continuously delivered to the insulating surface. The conductive plate and insulating surfaces are vibrated to cause the powder to slide onto the conductive plate and to impart the bouncing motion to the particles.

A frusto-conical upper plate is spaced above the lower plate and a high voltage direct current electrical field is created between the upper and lower plates. The upper plate has an opening through which the charged particles can pass. Particles passing through the opening are either electrostatically attracted toward or are conveyed toward the workpiece to be coated.

The general equation for determining the amount of charge which must be acquired in order for the particles to levitate is as follows:

$$qE \geqq mg$$

where q is the total charge on the particle, E is the electric field applied between the upper and lower surfaces; m is the mass of the particles and g is the acceleration of gravity. If the surfaces are in the shape of two parallel planes of separation d, the electric field in the absence of powder is the ratio of the applied voltage V between the surfaces to d, that is, $E=V/d$.

Contrasting the induction charging method and apparatus of the present invention to the corona charging method, several advantages are derived. First, the transfer efficiency is improved. All of the powder delivered by the system will be charged since it must be charged in order to levitate away from the lower plate. All uncharged or insufficiently charged powder returns to the vibrating lower plate to receive additional charge, thus obviating the need for cumbersome, expensive powder recirculation equipment. The charge-to-mass ratio obtainable with the present invention is as large as or larger than that ordinarily obtained with the corona system and is distributed much more uniformly among the various particles. In addition, there are no uncharged particles at the workpiece. This greatly reduces the necessity of recirculating powder that has fallen off the workpiece because of the absence of electrostatic bonding.

Second, contact or induction charging requires a lower voltage than corona charging. Whereas in corona charging the charging voltage may be as high as 100 kV, in the apparatus of the present invention voltage between the upper and lower surfaces may be as low as 1 kV under certain conditions. This lower voltage reduces the hazard of explosions, simplifies and accordingly reduces the cost of the electronics needed to support the process.

Third, the upper limit to the amount of charge which can be put on a powder particle by the method and apparatus of this invention is determined by the electrical breakdown field for the air surrounding the particle; in the corona method, other physical limitations come into play before this breakdown limit is reached. These limitations of corona charging specifically include the Pauthenier limit, which is a level of charging above which additional ions can no longer reach the particle to be charged, due to electrostatic repulsion. Thus, induction charging can produce more highly charged particles than can corona charging.

Further, unlike the corona system, one can completely divorce the powder deposition process from electric fields between the gun and the workpiece, thereby avoiding the Faraday caging effect. This elimination of Faraday caging will result in a more uniform deposition of powder on the workpiece surface.

The charging method of the present invention can have applications other than the coating of workpieces. For example, the invention can be used for powder sizing. A sample of powder is placed on the vibrating lower plate and the voltage gradually increased, the particles will be levitated as they satisfy the equation set forth above. From this equation, $qE \geqq mg$, the electric field threshold E required to levitate the particles is proportional to m/g. Since the charge on the particle is proportional to $r^2$ (reference: A.Y.H. Cho, Journal of Applied Physics, Vol. 35, No. 9, pp. 2561–2564, September 1964) where r is the particle radius, and since the mass of the particle is proportional to $r^3$, then the electric field threshold E necessary to levitate a particle is proportional to r. Consequently, at lower voltages, smaller particles will be levitated in the system. As the voltage is increased, the larger particles can be levitated. If size discrimination is not desired, however, the apparatus can be operated at sufficiently high voltage to levitate the entire size spectrum of particles present.

The throughput of charged powder in the present invention is a property of the lateral dimensions of the device, and increases with the area of the plates. These dimensions have no bearing on the establishment of a given electric field. Thus, scaling up of the geometry to permit greater throughput is readily accomplished. This is not the case for the corona charging method in which throughput is not easily increased even in principle.

The several features and objectives of the present invention will become more readily apparent from the following detailed description taken in conjunction with the accompanying drawings in which.

Figure 1:
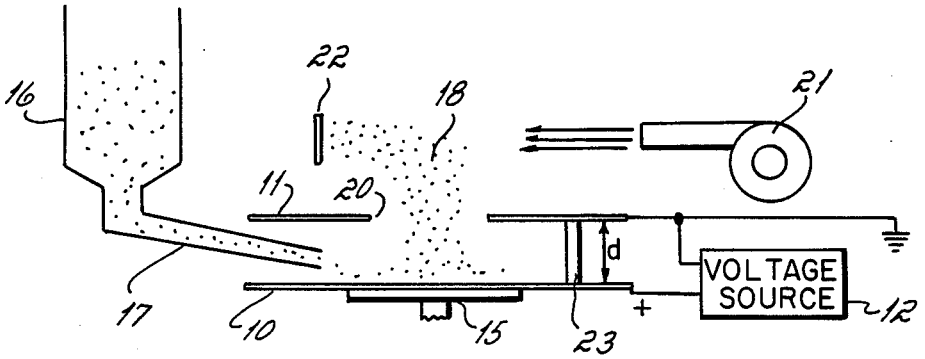
FIG. 1 is a diagrammatic illustration of one embodiment of the invention.

As shown in FIG. 1, the apparatus includes a lower plate 10 and an upper plate 11 spaced from the lower plate by a distance d. A direct current voltage source 12 is connected across the two plates 10 and 11. The voltage, for example 5000 volts, should be great enough to provide an electric field E of about 100 kV per meter. A wide range of electric field values may be employed. At lower values of E, the particles will acquire a larger charge q before levitating and vice versa. The higher q is, the greater the electrostatic attraction between the particle and the workpiece. The field could even be high enough to go into corona, but for spraying applications, the full benefits of induction charging may not be realized in the presence of a corona because of the unwanted buildup of corona-produced ions on the workpiece which repel the charged coating particles.

The upper plate is preferably at ground potential since in normal industrial practice the workpiece will also be at ground potential. The lower plate may be either positive or negative with respect to the upper plate.

A vibrator 15 is connected to the lower plate. The vibrator might, for example, be an electromagnet device of the type commonly used in acoustical speakers. The vibration imparted preferably has a frequency in the low acoustical range. Frequencies of 60 Hz to 440 Hz have been employed successfully. The amplitude of vibrations should be sufficient to cause particles to bounce, but it is undesirable for the particles to bounce too high since that increases the time to return to pick up additional charge.

A powder supply is diagrammatically illustrated at 16 and includes a chute 17 which continuously deposits powder onto the lower plate 10 at a rate equal to the rate of removal of the powder from the plate.

The upper plate has an opening 20 through which charged powder particles 18 may pass. A blower 21 is employed to cause a flow of air to pass over the outside of the upper plate 11 to drive the charged particles 18 toward a workpiece 22.

Since there will be some tendency for the charged particles 18 to adhere electrostatically to the upper plate 11, the upper plate is preferably mechanically connected by an insulating arm 23 to the lower plate so that vibrations imparted to the lower plate will also be imparted to the upper plate. Any particles impinging on the upper plate will be vibrated off by the vibrations of the upper plate. The upper and lower plates are metallic so as to be good conductors. The lower surface of the upper plate is preferably provided with a plastic overcoating to minimize powder adherence, thus making it easier to shake off particles which drift toward it.

In operation, the high voltage is applied between the upper and lower plates, and the plates are vibrated. Powder is delivered to the lower plate where it bounces freely on the lower plate as a result of the vibrating of the lower plate. With each contact with the lower plate, a charge is induced onto a portion of the surface of the contacting particle. Repeated contacts of the particle with the lower plate will cause additional charge to be imparted around the surface of the particle. When the particle is charged sufficiently to achieve the threshold charge, that is, the charge which satisfies the equation $qE \geqq mg$ the particle will levitate and drift upwardly toward the opening 20 in the upper plate. Particles passing above the opening will be entrained in the air emanating from the blower 21 and will be driven to the workpiece 22. Because there is no ion build-up around the surface of the workpiece and because there is no Faraday caging, the particles will distribute themselves substantially uniformly onto the surface of the workpiece. Thereafter, the workpiece will be transported to a conventional oven where the powder is baked onto the surface.

Figure 2:
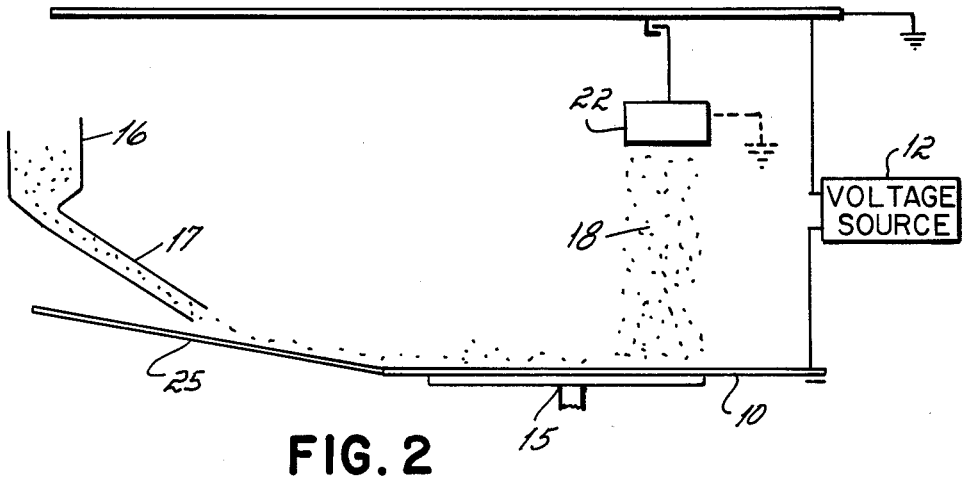
FIG. 2 is a diagrammatic illustration of another embodiment of the invention.

An alternative form of the invention is shown in FIG. 2. In this form of the invention, elements similar to or the same as the elements of FIG. 1 are given the same numerals and operate in the same way. The principal difference between the embodiment of FIG. 2 and the embodiment of FIG. 1 is that in the embodiment of FIG. 2 the workpiece 22 forms the upper surface and is conveyed out of the plane of the paper over the lower plate 10. In passing over the lower plate 10, the workpiece will pass through a cloud of charged particles 18. The workpiece, being at ground potential, will attract the particles which, due to their charge, will adhere to the workpiece. In this embodiment as well as in other embodiments, the lower plate 10 preferably has an insulating element 25 secured to its edge. The insulating element may completely surround the lower plate 10. Its function is to provide an inclined path for the particles 18 as they are discharged from the chute 17 of the hopper 16 onto the insulating element 25. Since the insulating element 25 is mechanically connected to the plate 10, it will vibrate with the plate 10 to enhance the flow of uncharged particles down the element 25 and into the plate 10.

Figure 3:
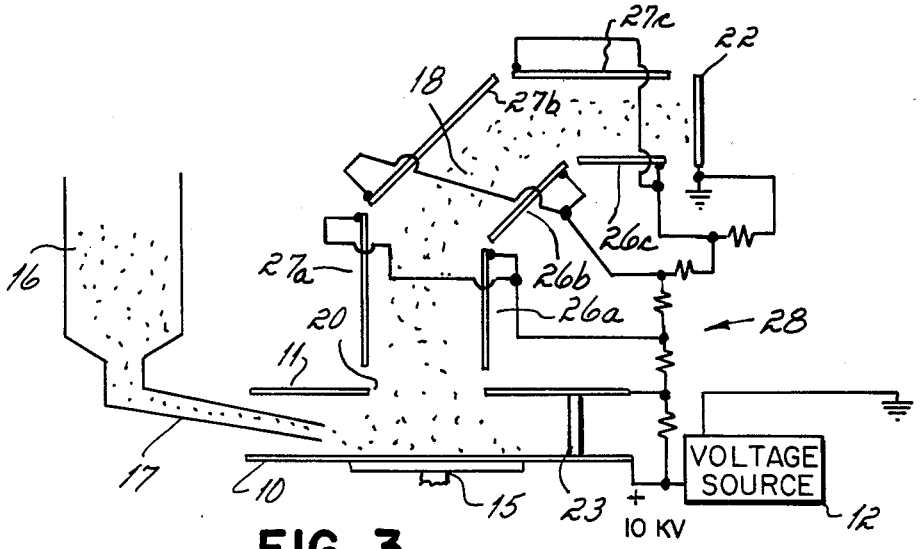
FIG. 3 is a diagrammatic illustration of another embodiment of the invention.

Another embodiment of the invention is shown in FIG. 3. The principal difference between the embodiment of FIG. 3 and the embodiment of FIG. 1 is the method and apparatus for transporting the charged particles toward the workpiece 22. Mounted above the opening 20 in the upper plate 11 is a series of spaced plates 26*a*, 27*a*; 26*b*, 27*b*; and 26*c*, 27*c* which create an electrostatic transport path for the particles.

The lower plate 10 is raised several thousand volts above ground potential, e.g., +10 kilovolts, to charge the particles. The upper plate 11 and the series of spaced plates 26*a*, 27*a*; 26*b*, 27*b*; and 26*c*, 27*c*, as well as the workpiece 22, are connected to the voltage source 12 by a voltage divider network 28 as shown. The workpiece 22 is grounded. By this arrangement, plate 10 is maintained at the highest potential and workpiece 22 at the lowest potential. The plate 11 is maintained at the next highest potential, with the plates 26*a*, 27*a*; 26*b*, 27*b*; and 26*c*, 27*c* being maintained at successively lower potentials with respect to the workpiece 22. This arrangement will provide for electrostatic transport of the charged particles since the particles will be attracted from the positively charged plates to the grounded workpiece.

The particles which pick up sufficient charge to levitate will be accelerated as they pass through the opening 20 of the upper plate 11. The plates 26*a*, 27*a*; 26*b*, 27*b*; and 26*c*, 27*c* will guide the charged particles to the workpiece 22.

Figure 4:
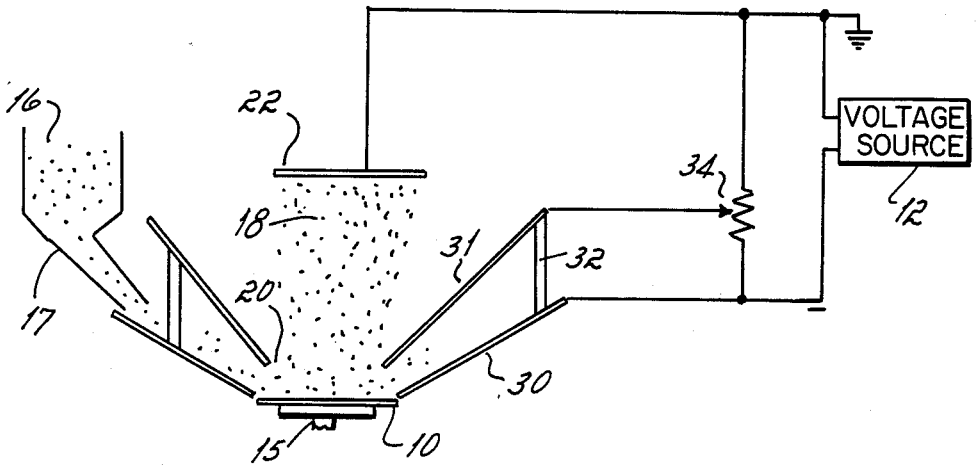
FIG. 4 is a diagrammatic illustration of another embodiment of the invention.

Another embodiment of the invention is shown in FIG. 4. There, the lower plate 10 is circular and is surrounded by a frusto-conical element 30 which is connected to the circular edge of the lower plate 10 and presents an upwardly and outwardly inclined surface. The chute 17 of the hopper 16 directs the powder onto the frusto-conical insulating element 30. The upper plate 31 is also in the shape of a frustrated cone and is mechanically connected by struts 32 to the insulating elements 30. A vibrator 15 is connected to the lower plate and the vibrations of the lower plate are imparted to the insulating element 30 as well as the upper plate by means of the struts 32. The high voltage supply 12 is connected by means of a voltage divider 34 across the lower and upper plates 10 and 31 with the workpiece being connected to ground potential.

The configuration of FIG. 4 provides an electric field which is strongest at the area of the exit hole 20. Opening 20 defines the stream of particles and guides it through the opening. Further, the potential difference between the lower plate 10 and the workpiece 22 is greater than the potential difference between the lower plate 10 and the upper plate 31, thereby imparting an accelerating effect to the charged particles as they levitate and move toward the opening 20. The rigid connection between the upper and lower plates is, as in the embodiment of FIG. 1, for the purpose of vibrating the upper plate along with the lower plate to facilitate the removal of powder caught on the upper plate and its return to the lower plate for further charging.

The voltage divider arrangement in FIG. 4, wherein voltages are applied to the lower and upper plates and to the workpiece, can also be applied to the configuration shown in FIG. 1.

Figure 5:
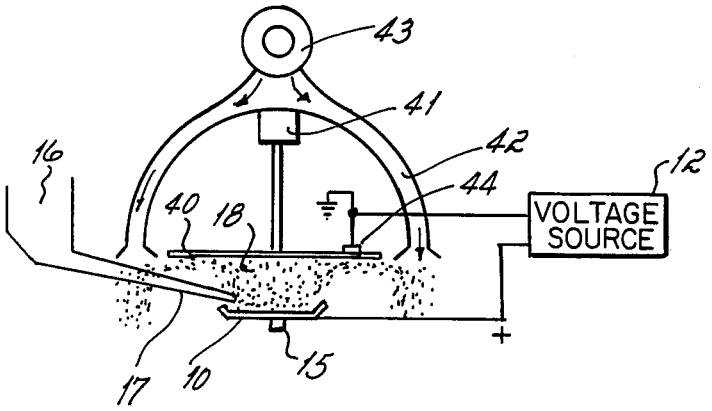
FIG. 5 is a diagrammatic illustration of another embodiment of the invention.

In the foregoing embodiments, the charged particles are moved upwardly. If it is desired to move the particles in a downward direction, the embodiment of FIG. 5 may be employed. In that embodiment, the lower plate 10 is structurally similar to the lower plate, surrounding insulating material, and powder delivery system of the previous embodiments. A vibrator 15 is connected to the lower plate assembly. The upper plate 40 is rotatably mounted and is driven by a motor 41 mounted on an air shroud-forming structure 42. The air shroud is circular and has a circular outlet surrounding and immediately adjacent to the perimeter of the top plate 40. A blower 43 drives air through the shroud so that the air exits adjacent to the edge of the plate 40. The plate 40 preferably has a plastic overcoating to minimize powder adherence. The upper plate is connected to the voltage supply by a slip ring 44.

A high voltage is applied between the upper and lower plates and the upper plate is rotated. The levitating particles which contact the upper plate are centrifugally driven toward the edge of the upper plate because of the rotation of the upper plate. As those particles pass the outer edge of the upper plate, they become entrained in the air emanating from the shroud 42 and are driven downwardly into contact with the workpiece passing below.

From a consideration of the foregoing embodiments, it is evident that many configurations are possible which carry out the fundamental concepts herein described. These concepts deal with the contact charging of powders in order to levitate them electrostatically. In the processes described, powder particles are introduced between two surfaces which set up a high electric field, and are allowed to contact the lower surface, at which they acquire charges by induction. To facilitate the many-point contact of insulating particles with the charging lower surface, the lower surface is vibrated. Other modifications employing this concept are intended to be embraced within the scope of the present invention as comprehended by the claims which follow.

Having described our invention, we claim:

1. Apparatus for charging and delivering powder particles comprising:

a lower plate, means for vibrating said lower plate, means for continuously delivering powder to said lower plate, a circular top plate spaced above said lower plate, means for rotating said top plate, a direct current high voltage source connected across said two plates to create an electrostatic field between them, a shroud of air of desired cross section surrounding said circular plate, and means for blowing air through said shroud and downwardly past said circular plate, whereby powder particles are charged by repeatedly bouncing on said lower plate until they levitate to said circular plate, said circular plate driving said particles by centrifugal force to its edge and the air emanating from said shroud driving said particles downwardly.

2. The method of charging powder particles comprising the steps of:

establishing an electric field between upper and lower surfaces, vibrating at least the lower surface, introducing uncharged particles to the vibrating surface, whereby the particles, as they repeatedly contact the lower surface, pick up electrostatic charges solely by electrostatic induction from the surface until the charge is sufficiently great to cause the particles to levitate according to the equation $$qE \geqq mg$$

where q is the charge on the particle, E is the applied electric field, m is the mass of the particle and g is the acceleration of gravity, and continuously removing levitating particles from the space between said surfaces.

3. The method as in claims 1 wherein the particles are charged at controlled levels up to the limit dictated by electrical breakdown of the surrounding air due to the high electric field of the charged particles.

4. The method as in claims 1 wherein the electric field between said two surfaces is about 100 kV per meter.

5. The method as in claims 1 wherein the frequency of vibration is in the range of frequencies in the audio range.

6. The method of delivering powder particles to a workpiece comprising the steps of:

establishing an electric field between upper and lower surfaces, introducing uncharged particles onto said lower surface, vibrating said lower surface to cause said particles to bounce upon it, thereby charging the particles solely by electrostatic induction, conveying those particles whose charge is sufficient to overcome gravity to said workpiece.

7. The method as in claim 6 wherein said workpiece forms said upper surface.

8. The method as in claim 6 wherein said upper surface has an opening through which particles may pass, the method comprising the further step of:

passing air over the top of said upper surface to entrain charged particles and deliver them to said workpiece.

9. The method as in claim 6 further comprising the step of:

establishing a second electrostatic field above said lower surface to entrain and guide charged particles toward said workpiece.

10. The method as in claim 6 further comprising the step of:

vibrating said upper surface to dislodge stray particles which contact the upper surface before being delivered to said workpiece.

11. Apparatus for charging powder particles comprising:

a pair of spaced upper and lower surfaces, means for applying a high voltage between said surfaces to establish an electric field therebetween, means for delivering particles continuously to said surface, means for vibrating said lower surface to charge said particles by repeated contact with said lower surface and solely by electrostatic induction, and means for removing levitating particles which are charged sufficiently to overcome gravity.

12. Apparatus as in claim 11 in which said upper surface is formed by a plate having an opening in it, said plate having a second surface on the opposite side of said plate from said upper surface, said removing means comprising means for passing air across said second surface to entrain particles levitating through said opening.

13. Apparatus as in claim 11 further comprising means for vibrating said upper surface to dislodge stray particles therefrom.

14. Apparatus as in claim 11 in which said upper surface has an opening therein, said apparatus further comprising:

a plurality of spaced plates above said opening and defining a path for the passage of charged particles, and means for applying an electric field to said plates for transporting and for deflecting charged particles along said path.

15. Apparatus as in claim 11 in which said upper surface comprises a workpiece to be coated with said powder particles.

16. Apparatus for charging powder particles comprising:

a lower horizontal conductive plate, an upwardly inclined insulating surface connected at its lower edge to said plate, means for vibrating said plate and surface, means for delivering powder to said inclined surface, a frusto-conical upper conductive member having a lower edge forming an opening above said conductive plate, and means for applying a high voltage across said plate and frusto-conical member, means for supporting a workpiece above said opening, whereby powder will be vibrated down to said conductive plate where repeated contact with said plate will charge each powder particle until its total charge is sufficient to levitate it through said opening.

17. Apparatus as in claim 16 wherein said voltage-applying means is connected to said workpiece to maintain it at ground potential, to said lower plate to maintain it at a high potential different from ground potential, and to said upper plate to maintain it at a potential between ground and that applied to said workpiece.

* * * * *